US009279638B2

(12) United States Patent
Adair et al.

(10) Patent No.: US 9,279,638 B2
(45) Date of Patent: Mar. 8, 2016

(54) RIFLE FOREND WITH INTEGRATED BARREL NUT

(71) Applicant: KNIGHT'S ARMAMENT COMPANY, Titusville, FL (US)

(72) Inventors: Nathan M. Adair, Orlando, FL (US); Matthew J. Domoradzki, Orlando, FL (US)

(73) Assignee: KNIGHT'S ARMAMENT COMPANY, Titusville, FL (US)

( * ) Notice: Subject to any disclaimer, the term of this patent is extended or adjusted under 35 U.S.C. 154(b) by 222 days.

(21) Appl. No.: 13/901,852

(22) Filed: May 24, 2013

(65) Prior Publication Data

US 2014/0345179 A1 Nov. 27, 2014

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01); *Y10T 29/49826* (2015.01)

(58) Field of Classification Search
CPC ..... F41A 21/48; F41A 21/482
USPC ..... 42/75.02, 75.01, 77, 71.01, 72
See application file for complete search history.

(56) References Cited

U.S. PATENT DOCUMENTS

| | | | | |
|---|---|---|---|---|
| 3,090,150 | A | 5/1963 | Stoner | |
| 5,412,895 | A * | 5/1995 | Krieger | 42/75.02 |
| 5,753,846 | A * | 5/1998 | Koon | 89/14.3 |
| 5,826,363 | A | 10/1998 | Olson | |
| 6,694,660 | B1 * | 2/2004 | Davies | 42/75.01 |
| 7,941,959 | B1 | 5/2011 | Swan | |
| 8,359,779 | B2 | 1/2013 | Daniel et al. | |
| 2011/0192066 | A1 * | 8/2011 | Kimmel et al. | 42/71.01 |
| 2011/0247254 | A1 * | 10/2011 | Barnes | 42/71.01 |
| 2014/0026459 | A1 * | 1/2014 | Yan et al. | 42/71.01 |
| 2014/0033590 | A1 * | 2/2014 | Gomez | 42/75.02 |

OTHER PUBLICATIONS

Home Workshop Guns for Defense and Resistance, Volume V by Bill Holmes dated Aug. 11, 2009.*

* cited by examiner

*Primary Examiner* — Reginald Tillman, Jr.
(74) *Attorney, Agent, or Firm* — Terry M. Sanks, Esq.; Beusse Wolter Sanks & Maire, PLLC

(57) ABSTRACT

An embodiment presents a rifle including an upper receiver, a barrel assembly connected to the upper receiver and a forend with an integrated barrel nut. The integrated barrel nut is connected to the barrel assembly such that the forend is directly connected to and aligned with the upper receiver. Another embodiment provides a method for assembling a firearm. The method includes inserting a barrel assembly into an upper receiver. The method also includes threading a forend with an integrated barrel nut over the outer surface of the barrel assembly. The method also includes checking an alignment between the upper receiver and the forend.

20 Claims, 5 Drawing Sheets

RIFLE FOREND WITH INTEGRATED BARREL NUT

FIELD OF THE INVENTION

The invention relates to firearms and more particularly, to a thread for a firearm.

Even more particularly, the invention relates to a rifle forend with an integrated barrel nut that may be used to assemble the rifle.

BACKGROUND OF THE INVENTION

FIG. 1 depicts a conventional rifle 10, including an upper receiver 12, a barrel 14, a forend 16 and a front sight 17. As illustrated in FIG. 1, the upper receiver 12 and the forend 16 are aligned in a longitudinal direction, so that accessories mounted on the upper receiver 12, such as a rear sight, can be properly aligned with accessories on the forend, such as forend-mounted target acquisition devices, for example. In conventional rifles, the upper receiver 12 and the forend 16 are aligned during assembly of the rifle 10, using a number of steps, as discussed herein.

As illustrated in FIG. 2, the barrel 14 may be first passed through an opening in the upper receiver 12 and an index pin (not shown) may be retracted into a notch in the upper receiver 12, when the barrel 14 and the upper receiver 12 are in a proper rotational alignment so ammunition can feed from the upper receiver 12 to the barrel 14. The barrel 14 may be then secured to the upper receiver 12 with a barrel nut 18, such as by engaging inner threads (not shown) of the barrel nut 18 with outer threads along the upper receiver 12. After the barrel 14 is secured to the upper receiver 12, the forend 16 may be subsequently secured to the barrel 14 in a manner so that the upper receiver 12 and the forend 16 are aligned. As illustrated in FIG. 2, the forend 16 may include a slot 19 sized to receive the barrel nut 18. A spring-loaded retaining ring 15 may then be provided to secure the forend 16 against the barrel nut 15. The user then checks the alignment between the upper receiver 12 and the forend 16. If they are not properly aligned, the positioning of the barrel nut 18 within the slot 19 is varied, until the upper receiver 12 and forend 16 are aligned. FIG. 3 depicts a cross-sectional view of the interface between the upper receiver 12 and the forend 16 in the conventional rifle 10. A longitudinal gap 13 separates the upper receiver 12 and the forend 16, and the retaining ring 15 may be positioned within the longitudinal gap 13.

Indeed, conventional rifles involve numerous components and steps to assemble the rifle 10 and properly align the upper receiver 12 and the forend 16. Thus, it would be beneficial to provide a more simplified rifle structure, which achieves alignment of the upper receiver and the forend with less effort, in a shorter time frame and with fewer parts.

BRIEF DESCRIPTION OF THE INVENTION

In one embodiment, a rifle is provided. The rifle includes an upper receiver, a barrel assembly connected to the upper receiver and a forend with an integrated barrel nut. The integrated barrel nut may be connected to the barrel assembly such that the forend is directly connected to and aligned with the upper receiver.

In another embodiment, a forend with an integrated barrel nut for a firearm is provided. The firearm includes the forend, an upper receiver and a barrel assembly. The forend may include a mating shoulder along an inner surface of the integrated barrel nut, where the mating shoulder is coupled to an outer surface of the barrel assembly. The forend may be configured to align with the upper receiver based on a rear surface of the mating shoulder seated against a front surface of a shoulder of the barrel assembly. The forend may be configured to align with the upper receiver based on the integrated barrel nut being coupled to the barrel assembly.

In another embodiment, a method is provided for assembling a firearm. The method includes inserting a barrel assembly of the firearm into an upper receiver of the firearm. The method may also include threading a forend with an integrated barrel nut over the outer surface of the barrel assembly. The method may also include checking an alignment at a predetermined torque value between the upper receiver and the forend.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
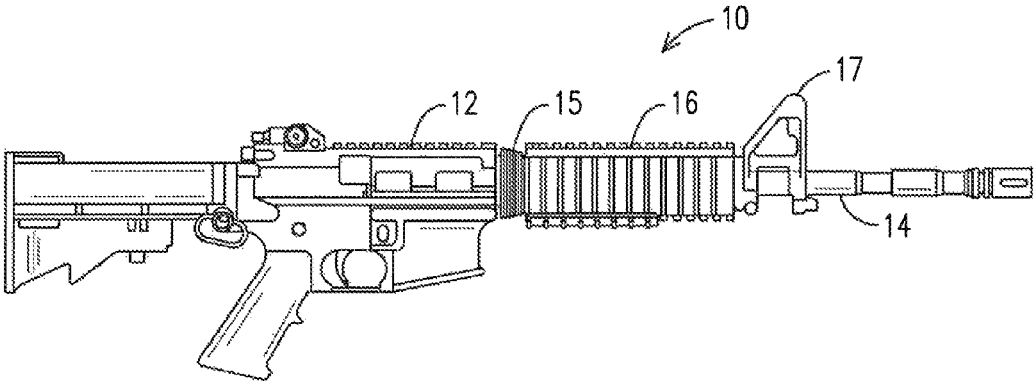
FIG. 1 is a side view of a conventional rifle.
Figure 2:
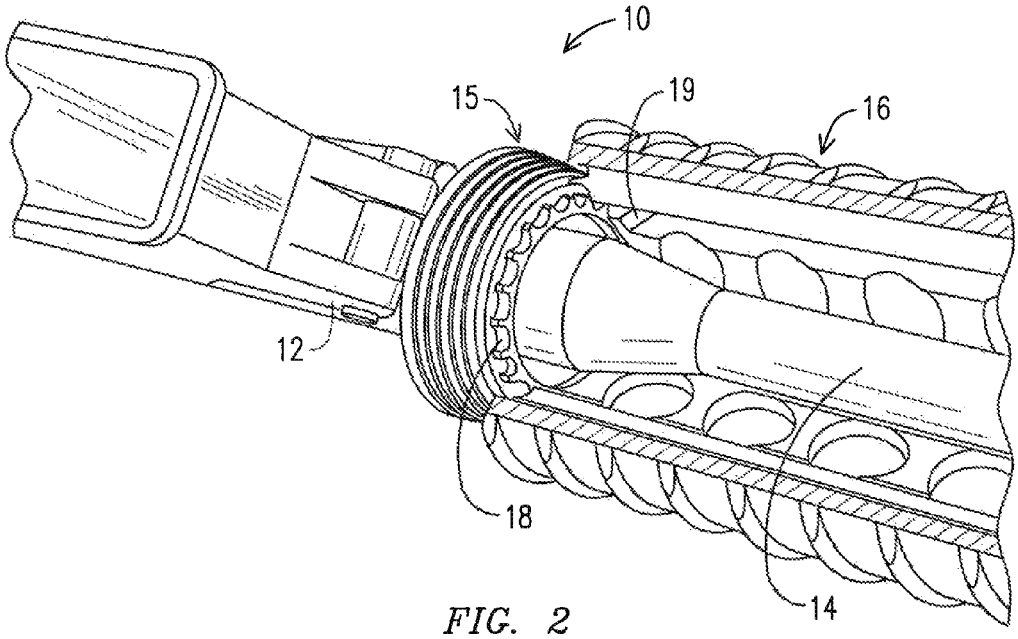
FIG. 2 is a bottom perspective view of a receiver-forend interface in the conventional rifle of FIG. 1.

In describing particular features of different embodiments, number references will be utilized in relation to the figures accompanying the specification. Similar or identical number references in different figures may be utilized to indicate similar or identical components among different embodiments.

The inventors recognized that conventional rifles involve a significant number of components and parts at the upper receiver-forend interface, resulting in costly manufacture and a significant number of steps in assembling the rifle and aligning the upper receiver and the forend. For example, as discussed above, conventional rifles 10 may involve various stages for assembling the upper receiver-forend interface: (1) connecting the barrel 14 to the upper receiver 12 with the barrel nut 18, (2) connecting the thread 16 to the barrel nut 18, and (3) positioning the retaining ring 15 in the longitudinal gap 13 between the upper receiver 12 and forend 16 to press the forend 16 against the barrel nut 18. The inventors recognized that, if the barrel nut 18 and the forend 16 were integrated, this may eliminate the second stage (2) above while also reducing the number of components.

Figure 5:
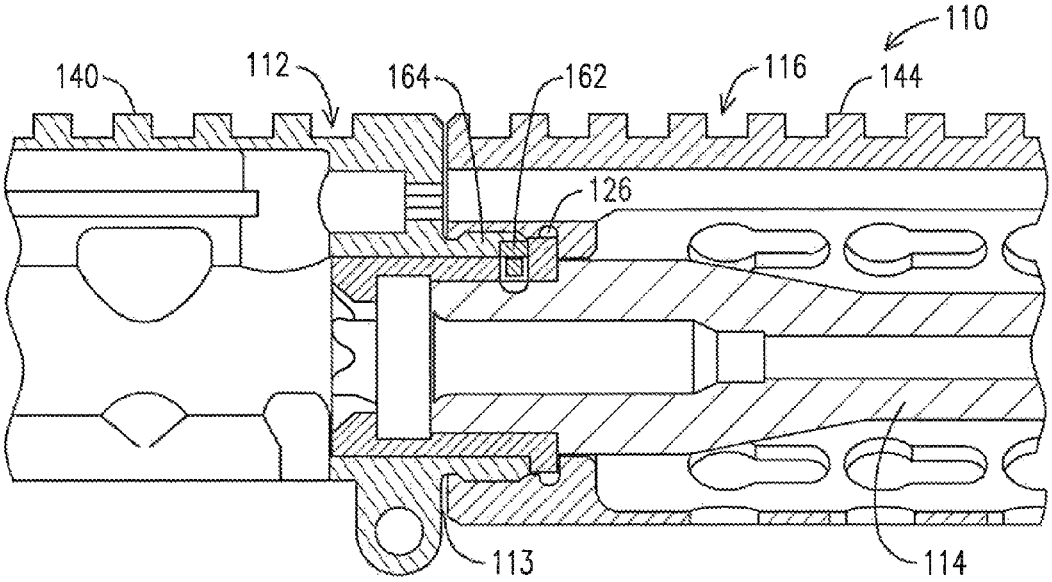
FIG. 5 is a cross-sectional side view of the interface in FIG. 4.
Figure 4:
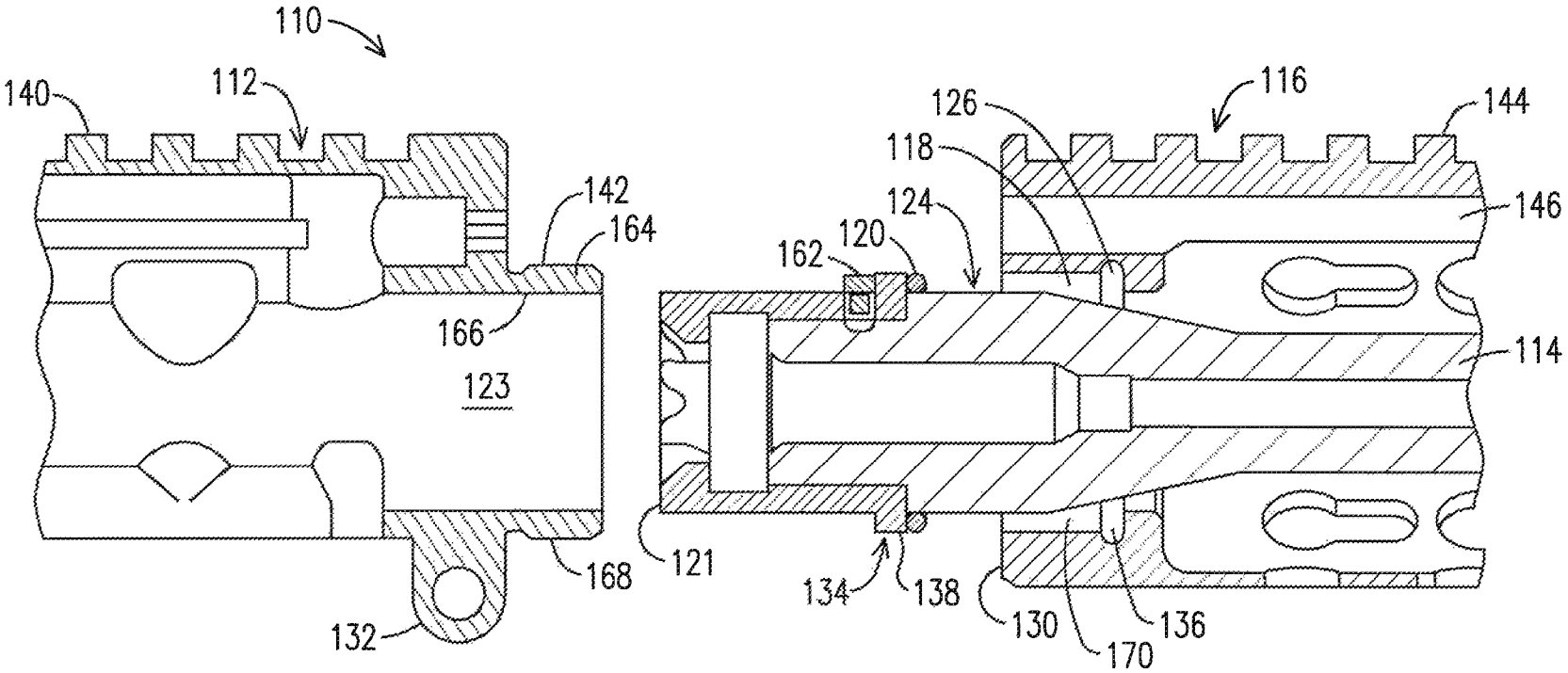
FIG. 4 is a cross-sectional exploded side view of an interface of a receiver and a forend with an integrated barrel nut in a rifle.

FIGS. 4-5 illustrate a firearm, such as a rifle 110, including an upper receiver 112 and a barrel assembly 114 connected to the upper receiver 112. The rifle 110 may also include a forend 116 with an integrated barrel nut 118. In one non-limiting example, the rifle 110 may be an M4®/M16® firearm (M4® and M16® are registered trademarks of Colt Defense, LLC). However, the embodiments are not limited to any particular rifle or firearm, provided that the firearm has an upper receiver and a forend which to be aligned during assembly. As discussed in greater detail below, the embodiments involve the improved forend 116 with the integrated barrel nut 118 where the integrated barrel nut 118 may be connected to the barrel assembly 114 so that the forend 116 is directed connected with the upper receiver 112, in order to align the forend 116 with the upper receiver 112.

As illustrated in FIG. 4, to assemble the rifle 110, a rear end 121 of the barrel assembly 114 may be first inserted into an opening 123 of the upper receiver 112. Upon inserting the rear end 121 of the barrel assembly 114 into the upper receiver 112, the barrel assembly 114 may be rotated within the upper receiver 112, until the barrel assembly 114 and the upper receiver 112 are rotatably aligned at a predetermined relative rotational alignment at which ammunition can properly be fed from the upper receiver 112 into the barrel assembly 114. The barrel assembly 114 includes an index pin 162 that may extend up into a notch 164 along an inner surface 166 of the upper receiver 112, to rotatably fix the barrel assembly 114 within the upper receiver 112 at the predetermined relative rotational alignment, when the barrel assembly 114 and the upper receiver 112 are aligned at the predetermined relative rotational alignment.

Upon securing the barrel assembly 114 within the upper receiver 112 at the correct rotational alignment, a shim 120 with a sized width may be positioned around an outer surface 124 of the barrel assembly 114. As illustrated in FIG. 4, the barrel assembly includes a shoulder 134 and the shim 120 may be positioned around the outer surface 124 on a front side of the shoulder 134. For purposes of this detailed description, "front" and "rear" may be used to describe a direction along a longitudinal axis of the rifle 110, where the "rear" direction is toward a stock portion of the rifle 110 and the "front" direction is toward a tip of the barrel assembly 114, as appreciated by one skilled in the art. As further illustrated in FIG. 4, the integrated barrel nut 118 of the forend 116 may have a mating shoulder 126 along an inner surface and on a front end of the integrated barrel nut 118. After the shim 120 is positioned over the outer surface 124 of the barrel assembly 114, the alignment between the forend 116 and the upper receiver 112 is initially checked. The alignment between the forend 116 and the upper receiver 112 is initially checked, since this initial alignment should be established before the forend 116 and upper receiver 112 are threaded together to achieve a required predetermined torque value. For purposes of this detailed description, an alignment between the forend 116 and the upper receiver 112 may be checked based on a longitudinal axis of the forend 116 coinciding with a longitudinal axis of the upper receiver 112. This alignment may be evaluated based on determining whether a top, side or bottom surface of the forend 116 is parallel to a respective top, side or bottom surface of the upper receiver 112. For example, FIG. 4 illustrates an upper rail 140 positioned on a top surface 142 of the upper receiver 112 and an upper rail 144 positioned on a top surface 146 of the forend 116. In one non-limiting example, the alignment between the upper receiver 112 and the forend 116 may be determined based on whether the upper rail 140 of the upper receiver 112 is aligned with the upper rail 144 of the forend 116. If the alignment between the forend 116 and the upper receiver 112 is initially achieved, the outer threads 168 of the upper receiver 112 are engaged with the inner threads 170 of the forend 116, to thread the forend 116 together with the upper receiver 112, until the required predetermined torque value is achieved and the shim 120 makes direct contact with the mating shoulder 126 of the integrated barrel nut 118 of the forend 116. Although the above steps involve positioning the shim 120 around the outer surface 124 on the front side of the shoulder 134, an alternate embodiment need not involve the shim 120 and instead would merely involve checking the alignment between the forend 116 and the upper receiver 112, before engaging the outer threads 168 of the upper receiver 112 with the inner threads 170 of the forend 116 with precise clocking, until the required predetermined torque value is achieved.

If the forend 116 is not initially aligned with the upper receiver 112 or the forend 116 is initially aligned with the upper receiver 112 but the forend 116 and the upper receiver 112 cannot be threaded together to achieve the required predetermined torque value, the forend 116 may be separated from the barrel assembly 114, to disengage the shim 120 and the mating shoulder 126. The shim 120 may then be replaced with a second shim (not shown) having a second width that is different than the first width of the first shim 120 that was used. After the second shim is positioned around the outer surface 124 of the barrel assembly 114, the above steps of alignment and threading of the forend 116 and the upper receiver 112 may be repeated for the second shim, until the alignment and the required predetermined torque value are simultaneously achieved between the forend 116 and the upper receiver 112. If the alignment and the required predetermined torque between the forend 116 and the upper receiver 112 are not simultaneously achieved, the second shim may be replaced with a third shim and the process may be repeated until an appropriate shim is positioned over the outer surface 124 so that simultaneous alignment and the required predetermined torque are achieved. As further illustrated in FIG. 4, in order to thread the integrated barrel nut 118 of the forend 116 over the barrel assembly 114, the integrated barrel nut 118 may include inner threads 170 along an inner surface, and the upper receiver 112 may include outer threads 168 along an outer surface, so that the inner threads 170 can engage the outer threads 168 in order to achieve the predetermined torque between the forend 116 and the upper receiver 112, thereby sandwiching the barrel assembly 114. However, the forend 116 and the upper receiver 112 are not limited to this thread arrangement, and may include any structural arrangement which adequately achieves the predetermined level of torque and secures the forend 116 to the barrel assembly 114.

Figure 3:
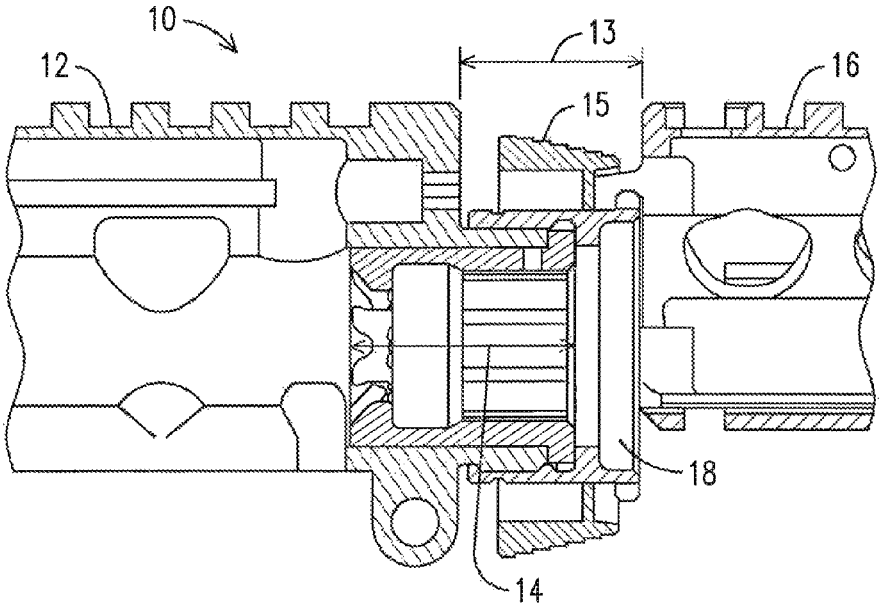
FIG. 3 is a cross-sectional side view of the receiver-forend interface of the conventional rifle in FIG. 2.

In addition to the direct contact between the shim 120 and the mating shoulder 126, the alignment between the upper receiver 112 and the forend 116 may be achieved through various other structural features of the interface between the upper receiver 112 and the forend 116. As illustrated in FIGS. 4-5, a rear end surface 130 of the forend 116 may be positioned within a small longitudinal gap 113 of a front end surface 132 of the upper receiver 112. In one non-limiting example, the small longitudinal gap 113 may be approximately 0.020". However, the small longitudinal gap 113 is not limited to this numerical dimension and may be any dimension, provided that proper compressive contact is achieved against the shoulder 134 and the load path passes through the shoulder 134 for proper structural integrity. By separating the rear end surface 130 of the forend 116 from the front end surface 132 of the upper receiver 112 by the small longitudinal gap 113, the rifle 110 may fill the longitudinal gap 13 in the conventional rifle 10 (FIG. 3) with additional rail 140, 144 space (FIG. 5). As further illustrated in FIGS. 4-5, a rear surface 136 of the mating shoulder 126 of the integrated barrel nut 118 may be seated against a front surface 138 of the shoulder 134 of the upper receiver 112, which further assists in the alignment of the upper receiver 112 with the forend 116.

Figure 6:
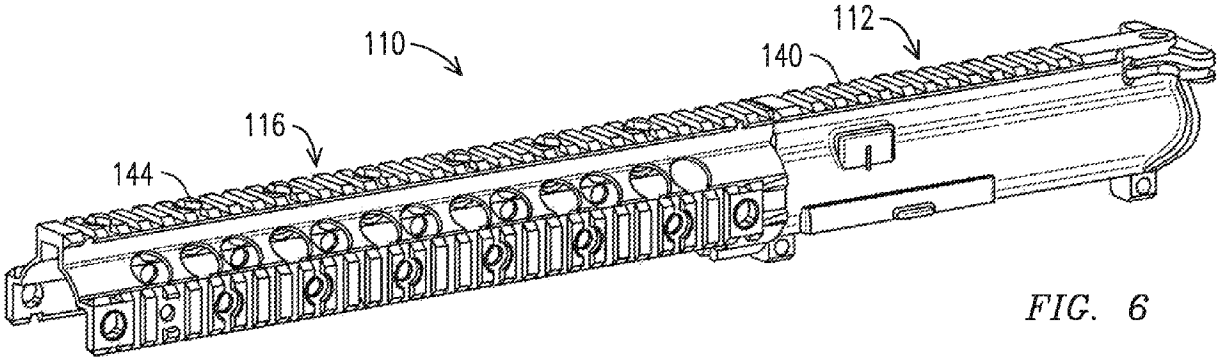
FIG. 6 is a side perspective isolated view of the receiver and the forend with the integrated barrel nut of FIG. 4.

As illustrated in FIG. 6, the forend 116 is shown aligned with the upper receiver 112, so that the upper rail 144 of the forend 116 may be aligned with the upper rail 140 of the upper receiver 112. In an embodiment, the upper rails 140, 144 may be MIL-STD-1913 rail sections, for example. However, the upper rails positioned on the top surfaces 142, 146 of the upper receiver 112 and forend 116 are not limited to any specific rail configuration, provided that the rails that are used on the upper receiver 112 and forend 116 can be used to mount various accessories and can be aligned in order to indicate that the upper receiver 112 and forend 116 are correspondingly aligned.

Figure 7:
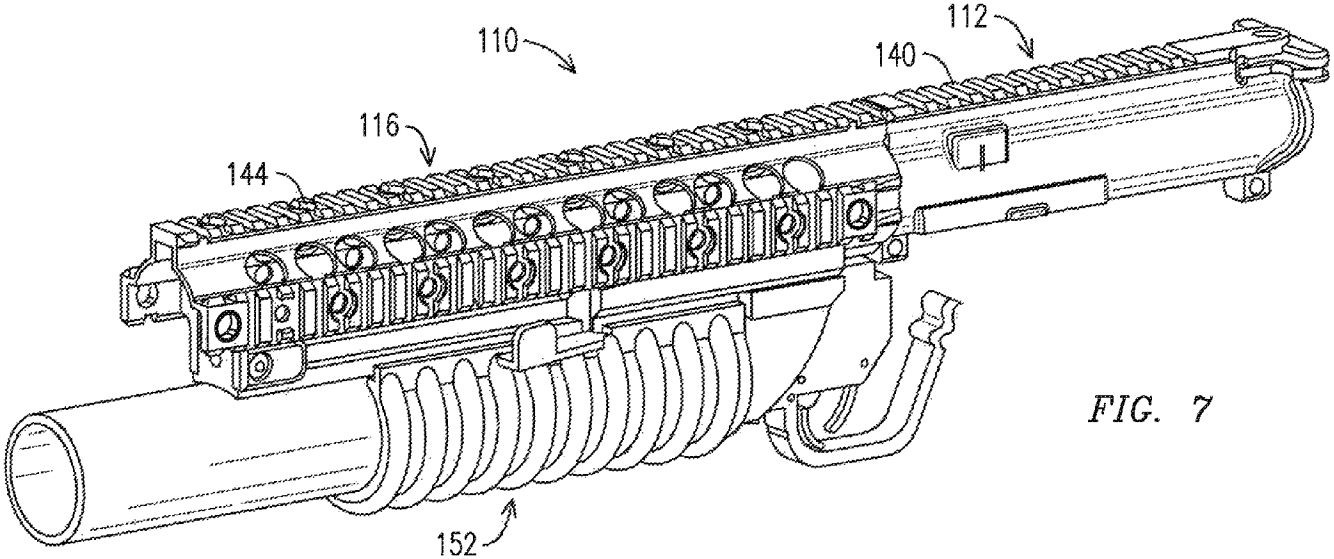
FIG. 7 is the side perspective view of the receiver and forend of FIG. 6 with a grenade launcher accessory mounted to the forend and positioned underneath a barrel assembly of the rifle.

As further illustrated in FIG. 6, the forend 116 is configured to mount an accessory along either a side region or a bottom region of the barrel assembly 114. In one non-limiting example, FIG. 7 illustrates a grenade launcher accessory 152 securely mounted to the forend 116, such that the grenade launcher accessory 152 can extend along a bottom region underneath the barrel assembly 114. As discussed above, the embodiments involve an interface of the upper receiver 112 and the forend 116 which aligns the upper receiver 112 and the forend 116. Thus, by mounting the accessory 152 to the forend 116, the accessory 152 may also be aligned with the upper receiver 112 and the forend 116, and can be effectively used.

Although the embodiments discussed above in relation to FIGS. 1-7 involve a rifle 110 with an interface between the forend 116 and the upper receiver 112, the embodiments need not include all elements of the rifle 110. In one embodiment, the forend 116 with the integrated barrel nut 118 may be used to convert a conventional rifle into the rifle 110 discussed above in FIGS. 1-7, by connecting the forend 116 and the integrated barrel nut 118 to a barrel assembly and an upper receiver of a conventional rifle, using the same steps discussed above for the rifle 110.

Figure 8:
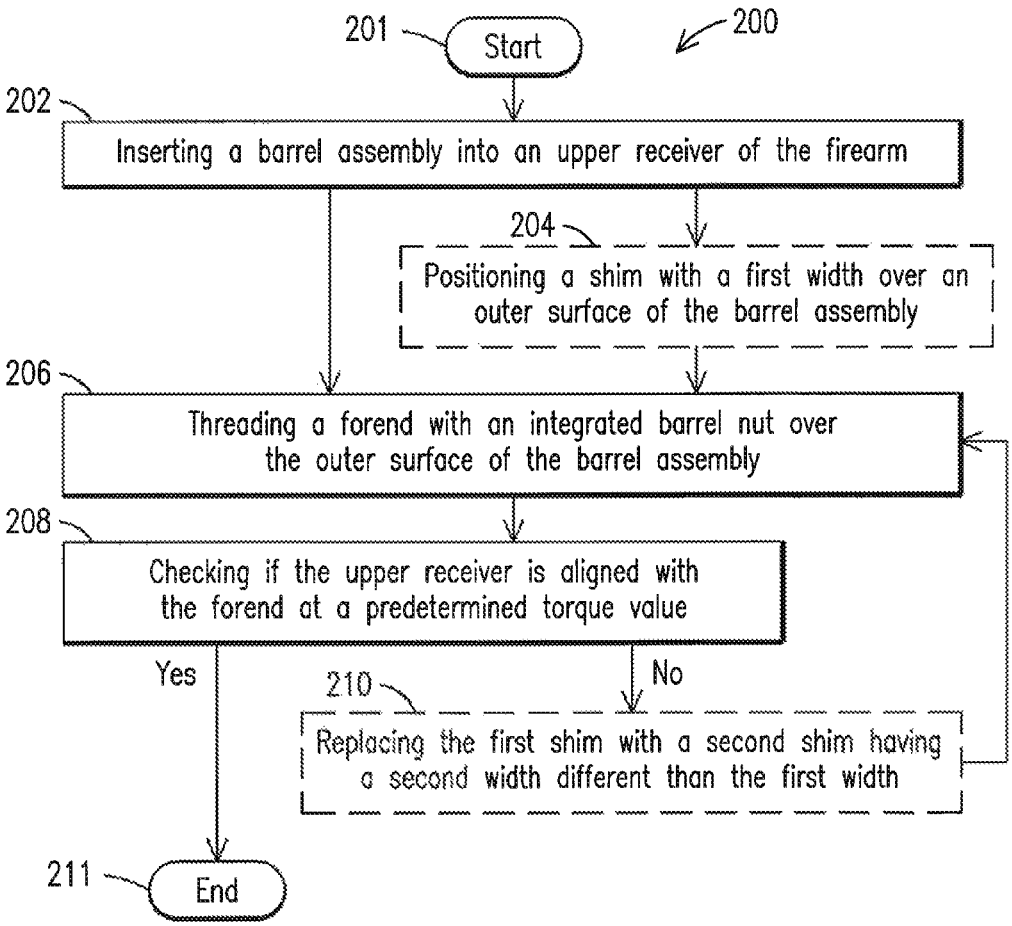
FIG. 8 is a flowchart depicting a method for assembling the rifle with the interface depicted in FIG. 4.

FIG. 8 illustrates a flowchart depicting a method 200 for assembling a firearm such as the rifle 110. The method 200 begins at 201 by inserting 202 the barrel assembly 114 into the upper receiver 112. The method 200 may further include positioning 204 the first shim 120 with a first width over the outer surface 124 of the barrel assembly 114. The method 200 may further include threading 206 the forend 116 with the integrated barrel nut 118 over the outer surface 124 of the upper receiver 112 to a predetermined torque value. The method 200 may further include checking 208 an alignment of the upper receiver 112 with the forend 116 at the predetermined torque value. The method 200 may further include replacing 210 the first shim 120 with a second shim having a second width different than the first width, if the upper receiver 112 and the forend 116 are not aligned at the predetermined torque value, before ending at 211. Although FIG. 8 appears to illustrate a particular sequence of steps in the method 200, these steps may be performed in alternate orders.

This written description uses examples to disclose embodiments, including the best mode, and also to enable any person skilled in the art to make and use the embodiments. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Therefore, the breadth and scope of the subject matter provided herein should not be limited by any of the above explicitly described embodiments. Rather, the scope of the embodiments should be defined in accordance with the following claims and their equivalents.

Numerous changes to the subject matter disclosed herein can be made in accordance with the embodiments disclosed herein without departing from the spirit or scope of the embodiments. In addition, while a particular feature may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Thus, while embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered.

What is claimed is:

1. A rifle comprising:

an upper receiver;

a barrel assembly connected to the upper receiver; and a forend with an integrated barrel nut forming a single unitary structure for attachment to said barrel assembly such that the forend is directly connected to and aligned with the upper receiver.

2. The rifle of claim 1, wherein said forend is aligned with the upper receiver and wherein said forend and said upper receiver are configured to achieve a predetermined torque value based on a shim of a selective width positioned between the barrel assembly and the integrated barrel nut.

3. The rifle of claim 1, wherein said forend is aligned with the upper receiver, wherein said forend includes inner threads, and said upper receiver includes outer threads such that the inner threads of the forend engage the outer threads of the upper receiver to achieve a predetermined torque value between the barrel assembly and the integrated barrel nut.

4. The rifle of claim 2, wherein said shim is positioned over an outer surface of the barrel assembly; wherein said integrated barrel nut includes a mating shoulder along an inner surface of the integrated barrel nut; and wherein said forend is aligned with the upper receiver based on direct contact between the shim and the mating shoulder.

5. The rifle of claim 1, wherein said integrated barrel nut includes a mating shoulder, wherein said barrel assembly includes a shoulder, and wherein said forend is aligned with the upper receiver based on a rear surface of the mating shoulder seated against a front surface of the shoulder.

6. The rifle of claim 1, wherein said forend is aligned with the upper receiver based on an upper rail on a top surface of the upper receiver being aligned with an upper rail positioned on a top surface of the forend.

7. The rifle of claim 6, wherein said forend is configured to mount an accessory along one of a side or a bottom region of the barrel assembly.

8. The rifle of claim 7, wherein the accessory is a grenade launcher mounted along the bottom region of the barrel assembly.

9. The rifle of claim 1, wherein said barrel assembly is connected to the upper receiver based on an indexed pin of the barrel assembly having extended into a notch along an inner surface of the upper receiver upon said barrel assembly and said upper receiver having a predetermined relative rotational alignment.

10. The rifle of claim 1, wherein the integrated barrel nut includes inner threads along an inner surface, wherein the upper receiver includes outer threads along an outer surface, and wherein the said integrated barrel nut is connected to the upper receiver based on the inner threads engagement with the outer threads.

11. A forend with an integrated barrel nut, to form a shale unitary structure, for a firearm, said firearm comprising the forend, an upper receiver and a barrel assembly, said forend comprising:

a mating shoulder along an inner surface of the integrated barrel nut, said mating shoulder coupled to an outer surface of the barrel assembly;

wherein said forend is configured to align with the upper receiver based on a rear surface of the mating shoulder being seated against a front surface of a shoulder of the barrel assembly; and wherein the forend is configured to align with the upper receiver based on the integrated barrel nut being coupled to the barrel assembly.

12. The forend of claim 11, further comprising a shim positioned over the outer surface of the barrel assembly, wherein the mating shoulder is configured to make direct contact with the shim and wherein the forend is configured to align with the upper receiver based on the direct contact between the integrated barrel nut and the barrel assembly.

13. The forend of claim 11, said forend further comprising an upper rail positioned on a top surface of the forend; wherein said forend is configured to align with the upper receiver based on an upper rail on a top surface of the upper receiver configured to align with the upper rail positioned on the top surface of the forend.

14. A method for assembling a firearm comprising:

inserting a barrel assembly of the firearm into an upper receiver of the firearm;

threading a forend with an integrated barrel nut, to form a single unitary piece, over the outer surface of the barrel assembly; and checking an alignment at a predetermined torque value between the upper receiver and the forend.

15. The method of claim 14, further comprising:

positioning a first shim with a first width over an outer surface of the barrel assembly; and replacing the first shim with a second shim having a second width different than the first width, if the upper receiver and the forend are not aligned at the predetermined torque value.

16. The method of claim 14, further comprising rotating the barrel assembly within the upper receiver and fixing the barrel assembly and the upper receiver at a predetermined relative rotational alignment.

17. The method of claim 14, further comprising providing an upper rail along a top surface of the upper receiver and providing an upper rail along a top surface of the forend, wherein said checking the alignment includes checking the alignment between the upper rail on the top surface of the upper receiver with the upper rail on the top surface of the forend.

18. A firearm having a barrel assembly, comprising:

a forend;

a barrel nut machined into the forend to form a single unitary structure; and a mating shoulder along an inner surface of the barrel nut, said mating shoulder coupled to an outer surface of the barrel assembly.

19. The firearm of claim 18, further comprising an upper receiver and a barrel assembly wherein said forend aligns with the upper receiver based on a rear surface of the mating shoulder being seated against a front surface of a shoulder of the barrel assembly.

20. The firearm of claim 19, further comprising an upper receiver and a barrel assembly wherein the forend aligns with the upper receiver based on the barrel nut being coupled to the barrel assembly.

* * * * *